US008665085B2

(12) United States Patent
Hyatt

(10) Patent No.: US 8,665,085 B2
(45) Date of Patent: Mar. 4, 2014

(54) TRACKING AND MONITORING SYSTEM

(76) Inventor: Dequincy A. Hyatt, Shelby Township, MI (US)

( * ) Notice: Subject to any disclaimer, the term of this patent is extended or adjusted under 35 U.S.C. 154(b) by 669 days.

(21) Appl. No.: 12/597,643

(22) PCT Filed: Apr. 25, 2008

(86) PCT No.: PCT/US2008/061518

§ 371 (c)(1),
(2), (4) Date: Oct. 26, 2009

(87) PCT Pub. No.: WO2008/134479

PCT Pub. Date: Nov. 6, 2008

(65) Prior Publication Data

US 2010/0117822 A1 May 13, 2010

(51) Int. Cl.
*G08B 1/08* (2006.01)
*G04B 47/06* (2006.01)

(52) U.S. Cl.
USPC ..... 340/539.12; 340/568.2; 340/573.4; 340/539.13; 368/14; 368/282; 70/14; 24/265 WS

(58) Field of Classification Search
USPC ..... 340/573.1, 568.2, 573.4, 539.31, 340/539.13, 539.1, 539.11, 539.15, 539.21, 340/539.12; 368/10, 47, 282, 14; 455/456.5; 70/14, 336, 448; 342/357.2, 342/357.21; 24/265 WS, 265 R, 265 RL
See application file for complete search history.

(56) References Cited

U.S. PATENT DOCUMENTS

| | | | | |
|---|---|---|---|---|
| 3,913,182 | A * | 10/1975 | Fontana | 24/71 J |
| 5,448,846 | A * | 9/1995 | Peterson et al. | 40/633 |
| 5,831,535 | A | 11/1998 | Reisman et al. | |
| 6,847,295 | B1 * | 1/2005 | Taliaferro et al. | 340/539.13 |
| 7,515,053 | B2 * | 4/2009 | Klein | 340/572.8 |
| 7,682,069 | B2 * | 3/2010 | Hyatt | 368/282 |
| 2001/0055243 | A1 * | 12/2001 | Haywood | 368/10 |
| 2003/0210149 | A1 | 11/2003 | Reisman et al. | |

FOREIGN PATENT DOCUMENTS

GB 2 225 141 5/1990

OTHER PUBLICATIONS

International Search Report for PCT Application No. PCT/US2008/061518, Jul. 18, 2008.

* cited by examiner

*Primary Examiner* — Anh V La
(74) *Attorney, Agent, or Firm* — Carlson, Gaskey & Olds PC

(57) ABSTRACT

A tracking device is incorporated into a band, such as a watch band or bracelet. The tracking device appears as an ordinary band, but cannot be removed by the individual wearing it. If necessary, the location of the tracking device can be determined by a central server and reported to the authorities or to the individual's family.

18 Claims, 6 Drawing Sheets

TRACKING AND MONITORING SYSTEM

This application is a National Phase application of International Application PCT/US2008/061518, which is a PCT application claiming priority to U.S. application Ser. Nos. 11/739,898 and 11/838,963, filed Apr. 25, 2007 and Aug. 15, 2007, respectively.

BACKGROUND

The present invention relates generally to tracking devices and more particularly to a tracking device which is not removable by the user.

Systems for tracking and monitoring individuals have been developed for several different applications. First, convicted criminals may be sentenced to stay at home for a period of time. If the individual leaves their home without authorization, the authorities activate the tracking device to locate the individual and arrest him. In another application, an individual who has been released on bail may be required to wear a tracking device to ensure his appearance in court for the hearing and for the trial. In these applications, a large, conspicuous electronic device is locked to the individual's ankle and cannot be removed by the individual. Upon activation by the authorities, the location of the individual can be tracked using GPS, cell towers, etc.

Individual tracking devices are also used for Alzheimer's patients. These patients may become confused or disoriented and simply "wander off." Because these individuals are not consciously trying to avoid being located, their tracking devices need not be locked to the individual. It is not expected that these individuals would make any attempt to remove the tracking device, or that they would even be aware of the tracking device.

However, there is yet another class of individuals for whom tracking and monitoring would be beneficial, who might at times attempt to remove the tracking device, but do not deserve to be treated as criminals. Some mentally ill patients, even mentally ill patients who can function very well when diligently taking their prescribed medications, may occasionally have relapses if they stop taking their medication. During these times, the person may become confused or delusional and may either wander aimlessly or travel quite deliberately long distances while suffering from their delusions. During this time, family members may be unable to locate the individual and get them the help and medication that they need. During these episodes, these individuals may try to remove the tracking devices. However, the conspicuous ankle bracelets used on criminals are inappropriate for these individuals, especially because they are able to function quite normally when taking medication.

SUMMARY

The present invention provides a tracking device that cannot be removed by the user, but does not appear unusual to other observers. In the embodiments disclosed herein, the tracking device is configured into the form of a band, bracelet or watch. The band is lockable such that it cannot be removed by the wearer, but there is no outward indication that the band includes a tracking device or is anything other than an ordinary band, bracelet or watch.

Like the known tracking devices, the tracking device includes a GPS receiver or other locating device, such as a cell phone chip (or similar). The tracking device may include some means of communicating its location to a central monitoring system. When activated through the central monitoring system, the tracking device transmits its location, to the central monitoring system or the location is determined by the cell tower system (or similar technology).

These and other features of the application can be best understood from the following specification and drawings, the following of which is a brief description.

DETAILED DESCRIPTION OF THE PREFERRED EMBODIMENT

Figure 1A:
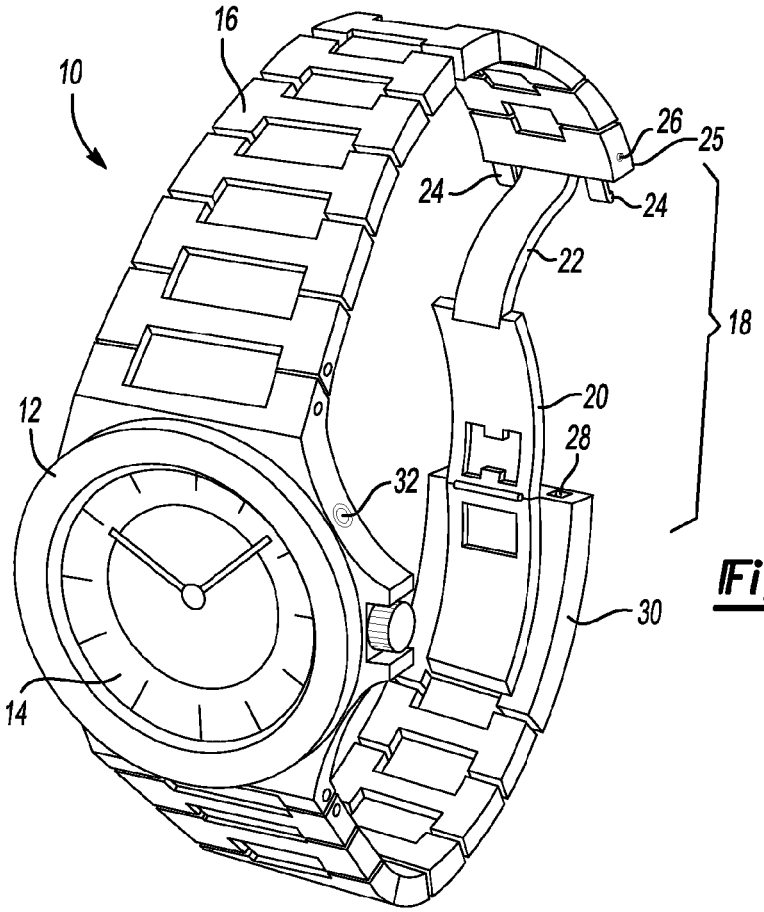
FIG. 1A is a perspective view of a tracking device according a first embodiment of the present invention.

FIG. 1A is a perspective view of a tracking device 10 according to a first embodiment of the present invention. The tracking device 10 includes a watch body 12 having a watch display, such as watch face 14 (watch display could also be a digital display). A watchband 16 is connected to the watch body 12 and is selectively closable by a fastening system 18. The fastening system 18 includes a first curved bar 20 and second curved bar 22 pivotably connected and connecting a first connecting link 25 and a second connecting link 30. A first connecting link 25 includes a pair of hooks 24 extending therefrom. The hooks 24 are selectively lockable by keyway 26. The hooks 24 are also receivable within apertures 28 on the second connecting link 30.

The watch body 12 is fully functional as a watch, including watch hands on a watch face 14. Alternatively, digital watches could also be provided in any of the embodiments shown in this application. The watch body 12 further includes an optional "panic" or "help" button 32 that is recessed into the body 12.

Figure 1B:
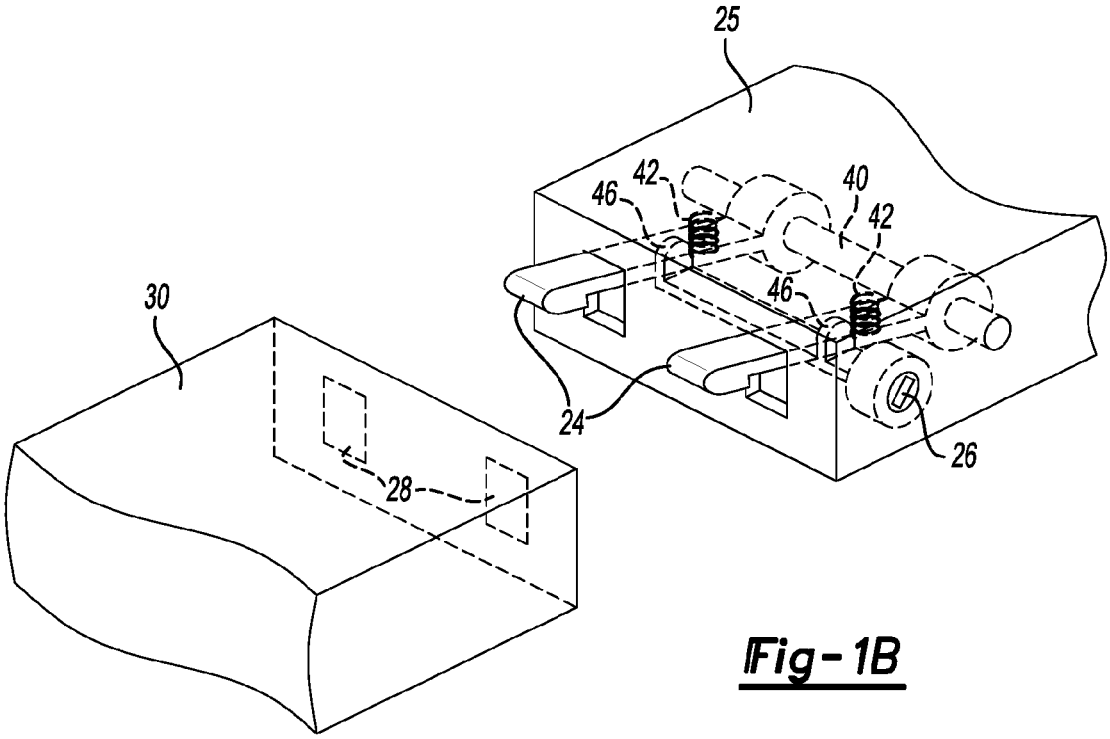
FIG. 1B is an enlarged view of the two ends of the watchband of FIG. 1A.

Referring to FIG. 1B, inside the first connecting link 25, the hooks 24 are pivotable on (or pivotable with) a shaft 40 and are biased toward a locked position by springs 42. The hooks 24 are biased downwardly by the springs 42 and can be selectively released by cams 46 rotatable by the keyway 26.

The second connector link 30 includes apertures 28 into which the hooks 24 can be received and to which the hooks 24 are latched. When the hooks 24 are inserted into the apertures 28 and the keyway 26 is rotated to the lock position, the springs 42 bias the hooks 24 downwardly, thereby locking the hooks 24 in the apertures 28 and locking the first connector link 25 to the second connector link 30. In this position, the tracking device 10 cannot be removed from the user's wrist. The keyway 26 can be rotated such that the cams 46 push the hooks 24 upwardly, thereby releasing the hooks 24 from the apertures 28 so that they can be removed from the apertures 28 and the first connecting link 25 can be separated from the second connecting link 30 and the tracking device 10 can be removed.

Figure 2A:
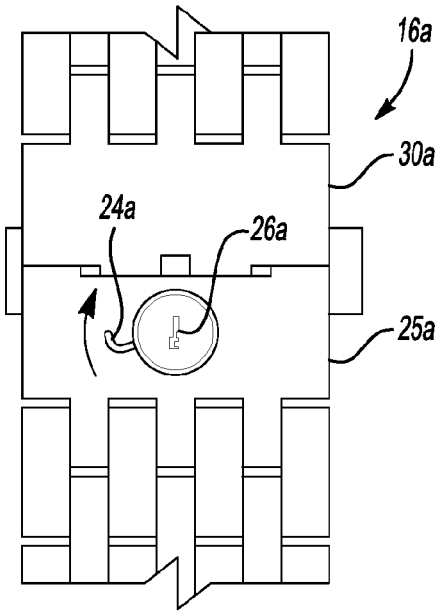
FIG. 2A is an enlarged view of two ends of an alternate watchband.
Figure 2B:
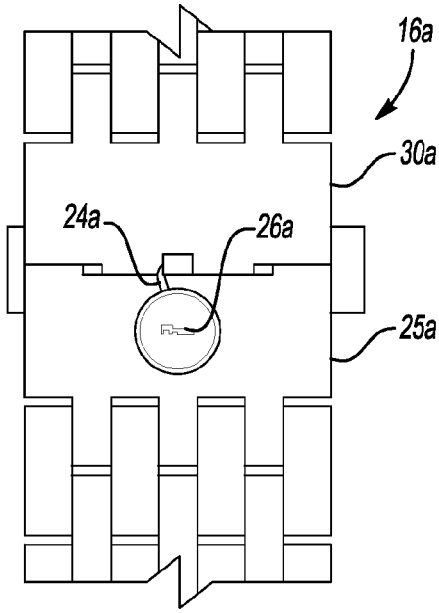
FIG. 2B illustrates the watchband of FIG. 2A in a locked position.

FIGS. 2A and 2B show an alternate connection mechanism. A first connector link 25*a* is connected to a second connector link 30*a* by a rotating keyway 26*a*. A hook 24*a* rotates inside the first connector link 25*a* upward rotation of the keyway 26*a*. The hooks 24*a* is received within an aperture (not visible) in the second connector link 30*a*, thereby rendering the watchband 16*a* irremovable from the user. The watchband 16*a* can then be removed by unlocking the second connector link 30*a* from the first connector link 25*a* by rotation of the keyway 26*a*.

Figure 3:
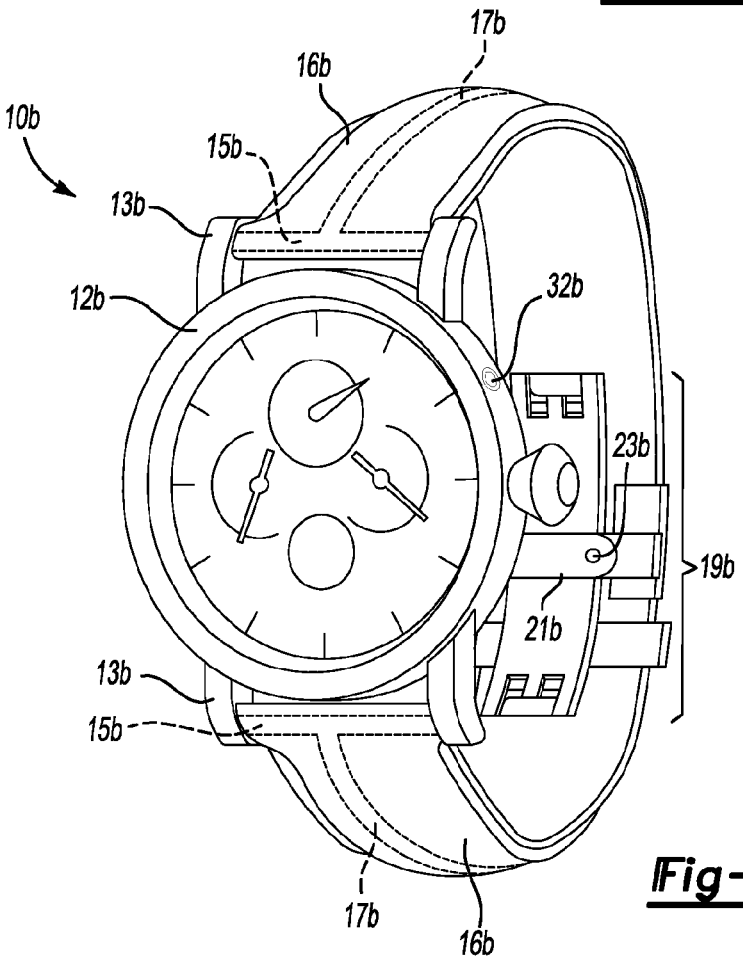
FIG. 3 illustrates an alternate tracking device.

FIG. 3 illustrates a third embodiment of a tracking device 10*b*. A watch body 12*b* includes two pair of spaced apart prongs 13*b* connected by a crossbar 15*b*. A flexible braided cable 17*b* is connected to each crossbar 15*b*. The cable 17*b* and crossbar 15*b* are hidden inside another (or other material) watchband 16*b*. The connection between the two watchband halves may be as indicated in FIG. 1A and FIG. 1B. An adjustment mechanism 19*b* is also provided. The adjustment mechanism 19*b* is similar to known watchband mechanisms in which a lever clamps down onto the watchband halves. However, in the tracking device 10*b*, the lever 21*b* is retained by a fastener, such as an Allen screw 23*b*. Thus, adjustment of the watchband 16*b* can be provided, but the watchband 16*b* cannot be adjusted while the user is wearing the tracking device 10*b*. Again the tracking device 10*b* is connected and disconnected similar to the connection system 18 of FIGS. 1A and 1B.

Figure 4:
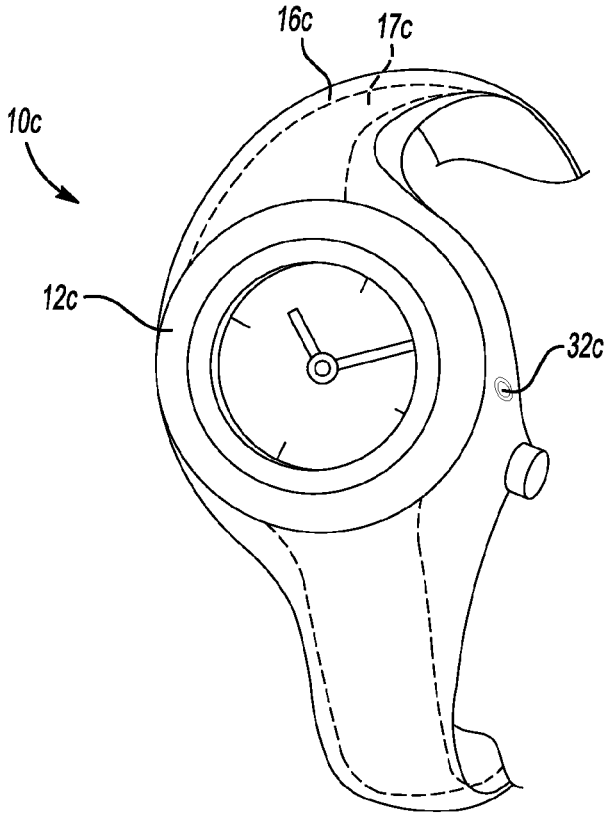
FIG. 4 illustrates a third alternate tracking device.

FIG. 4 illustrates another embodiment of the tracking device 10*c*. In this embodiment, a flexible metal band or braided cable 17*c* is connected directly to the watch body 12*c*, such as by welding, soldering, or other permanent connection. The cable 17*c* is hidden within the leather (or other material) band 16*c* such that the tracking device 10*c* appears to be an ordinary watch. The watchband 16*c* is connected and disconnected according to any of the connection systems of FIGS. 1-3.

Figure 5:
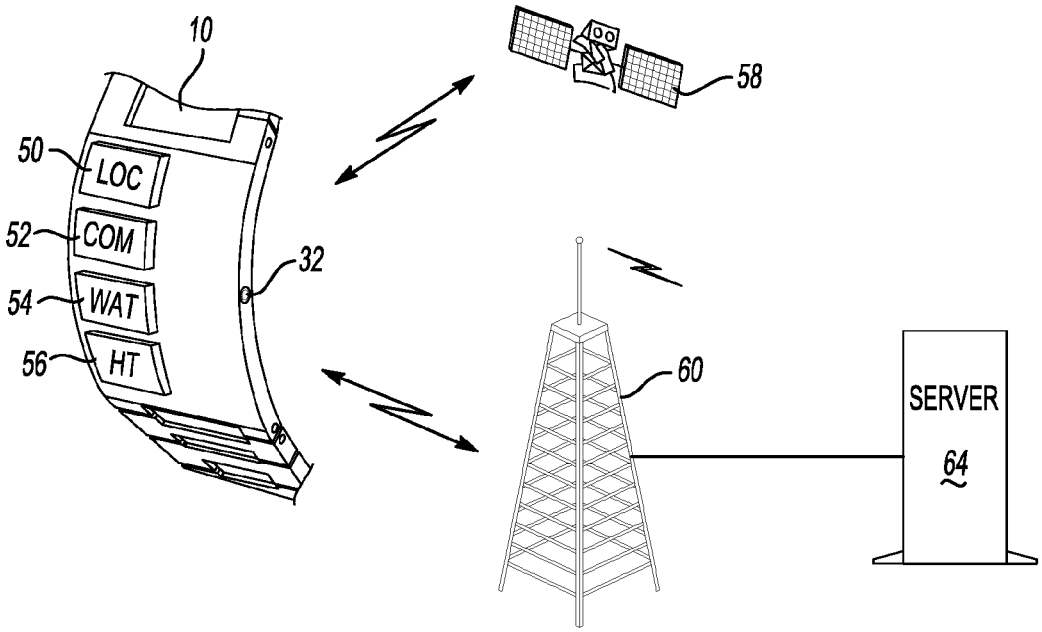
FIG. 5 is a schematic of a tracking and monitoring system including one of the tracking devices of FIGS. 1-4.

FIG. 5 is a schematic illustrating a tracking and monitoring system in which the tracking device 10 can be used. The tracking device 10 can be any of the tracking devices 10, 10*a*, 10*b*, 10*c* of FIGS. 1-4 or any suitable variation. The tracking device 10 includes locating circuitry 50 (such as GPS receiver or cell phone circuitry whose location is determined by cell towers 60). The tracking device 10 may further include communication circuitry 52, such as cell phone or other wireless data transmission circuitry. The tracking device 10 further includes a watch function 54, such that the tracking device 10 operates and appears as a normal watch. The tracking device 10 may optionally include a health monitoring circuit 56, such as for monitoring heart rate, blood pressure, temperature, blood sugar and stress. This health related information can be used to either trigger a communication or can be periodically transmitted from the tracking device via communication circuitry 52, or can be retrieved via the communication circuitry 52. The health monitoring circuit 56 also ensures that the tracking device 10 is secured to the user, in that the health monitoring circuit 56 sends a signal to the server 64 when health signals cannot be measured (i.e. no heartbeat, no blood pressure, no temperature, etc), thereby indicating that the user may have removed the tracking device.

The tracking device 10 further includes a panic or help button 32, with which the user can request assistance by initiating communication via the communication circuitry 52, which automatically transmits the location of the tracking device 10 as determined by the locating circuitry 50 (if the location of the tracking device 10 has not already been determined directly by the cell towers 60), and optionally health related information to a cell tower 60 or other external communication circuitry (including wi-fi, or other data communication protocalls). The cell tower 60 is in communication with a central server 64. The central server 64 is equipped to monitor thousands of such tracking devices over a large area. The identification of the individual wearing the tracking device is stored in the server 63 and associated with that particular tracking device. Health information, contact information, historical information are all stored on server 64 and associated with that individual's tracking device 10. Satellites 58 also communicate with tracking device 10, including the locating circuitry 50 and optionally the communication circuitry 52.

In use, if an individual is reported missing by their family, the server 64 can track the location of the individual's tracking device 10 and report that location to the family or to the authorities. The operators monitoring the server 64 can also track the health status of the individual wearing the tracking device 10 and report this to the family members or other authorities.

In some situations, if the individual wearing the tracking device 10 becomes lost or otherwise is in need of assistance, they either can press the help or panic button 32 which will initiate a call for help to the central server 64.

Figure 6:
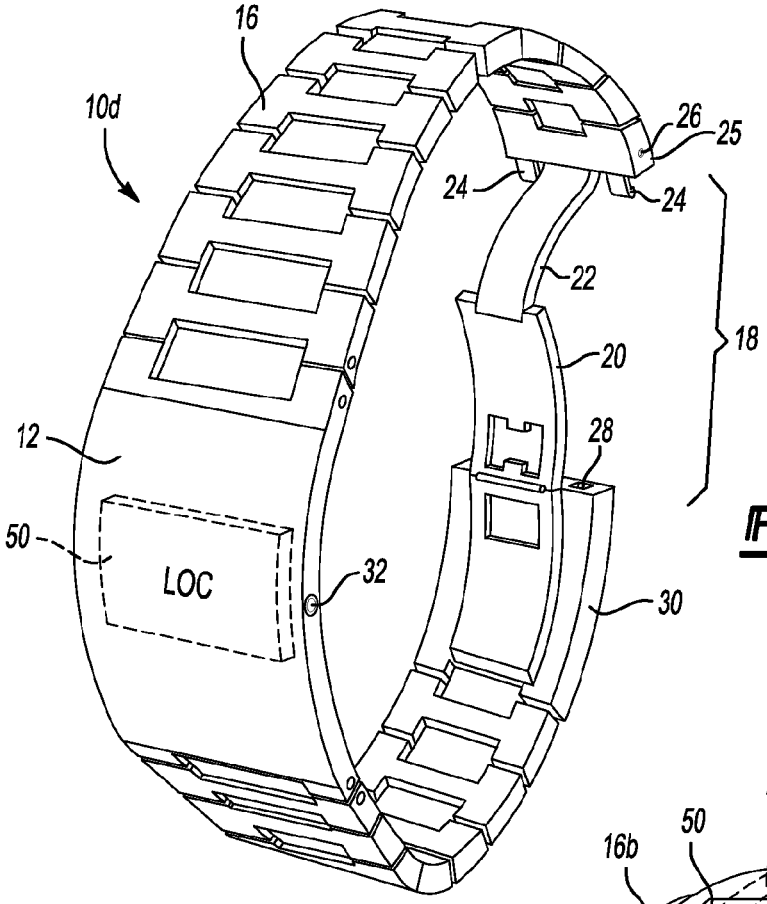
FIG. 6 illustrates a tracking device according to a fourth alternate embodiment.

FIG. 6 illustrates a tracking device 10*d* according to a fourth alternate embodiment. In the tracking device 10*d*, a locating circuitry 50 is hidden inside a body 12 of the tracking device 10*d* (or alternatively, inside the band 16). The tracking device 10*d* is substantially similar to the tracking device 10*a* of FIGS. 1A and 1B, except that there is no watch face or display and the tracking device 10*d* is just a bracelet. Other variations are possible, but the band 16 and fastening system 18 may be as shown in the embodiment of FIGS. 1A and 1B.

Figure 7:
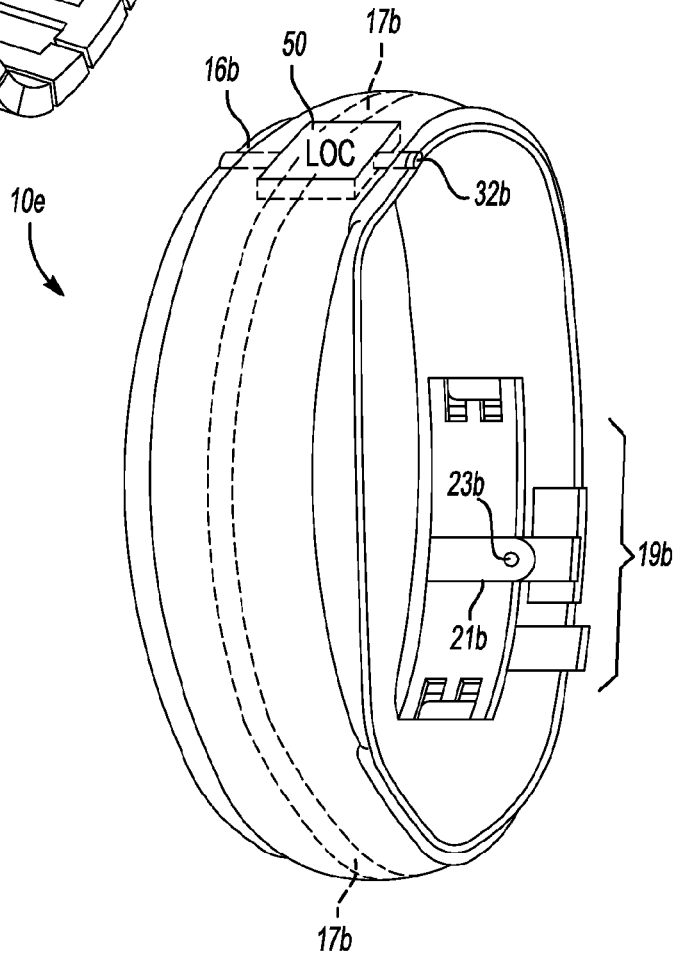
FIG. 7 illustrates a tracking device according to a fifth alternate embodiment.

FIG. 7 illustrates a tracking device 10*e* according to a fifth alternate embodiment. Locating circuitry 50 is hidden inside of the tracking device 10*e* (in this embodiment, inside the band 16). The tracking device 10*e* is substantially similar to the tracking device 10*a* of FIG. 3, except that there is no watch 12*b* and the tracking device 10*d* is just a bracelet. Other variations are possible, but the band 16*b* and fastening system 19*b* may be as shown in the embodiment of FIG. 3.

Figure 8:
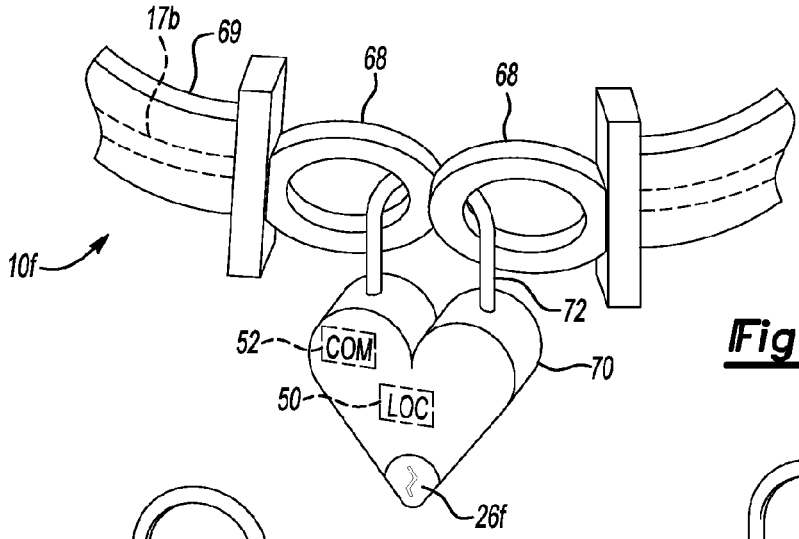
FIG. 8 illustrates a tracking device according to a sixth alternate embodiment.

FIG. 8 illustrates a tracking device 10*f* according to a sixth alternate embodiment. Locating circuitry 50 is hidden inside of the tracking device 10*f*, in this embodiment, inside a lock 70. The lock 70 may also conceal a communication circuit 52. The lock 70 includes a U-shaped portion 72 that is retractable and pivotable relative to the body of the lock 70, similar to known padlocks. The lock 70 is selectively operated by a key-way 26*f*, again, in a manner similar to known padlocks. In this embodiment, the lock 70 connects to eyelets 68 that are welded or otherwise permanently secured to a cable 17*b*, which is hidden in a band 69, in a manner similar to FIG. 3.

The band 69 could be leather or other material, which is fashionable and hides the cable 17*b*, which prevents the band 69 from being cut.

Figure 10:
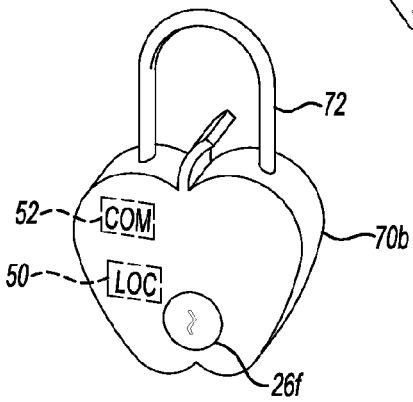
FIG. 10 illustrates a second alternate lock that can be used in the tracking device of FIG. 8.
Figure 9:
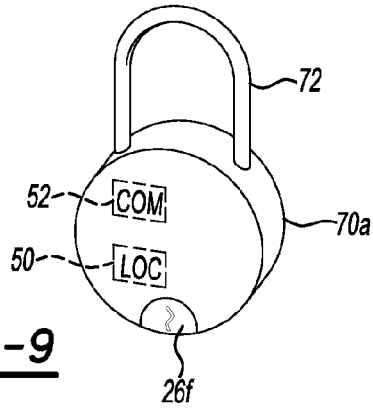
FIG. 9 illustrates an alternate lock that can be used in the tracking device of FIG. 8.
Figure 11:
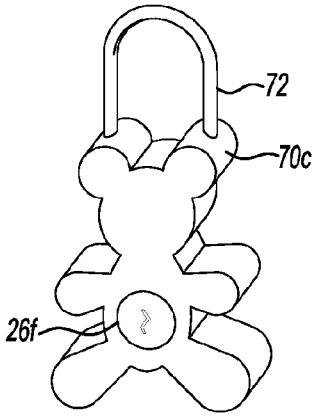
FIG. 11 illustrates a third alternate lock that can be used in the tracking device of FIG. 8.

FIGS. 9-11 show alternate locks 70*a*, 70*b* and 70*c*. All of the locks 70, 70*a*-70*c* have a decorative shape, which hides the fact that it is a lock and that it contains a tracking device. Other shapes could be utilized as well.

Figure 12:
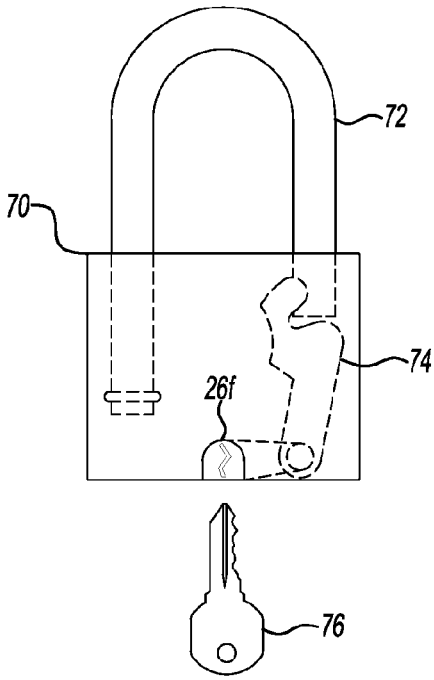
FIG. 12 schematically illustrates a locking mechanism that can be used in the locks of FIGS. 8-11.

FIG. 12 schematically illustrates one of the locks, such as lock 70. Generally, a latch 74 selectively is latched to the U-shaped portion 72 by operation of the key-way 26*f* with a key 76. Many such locks are known in existing padlocks and any design could be used.

Figure 13:
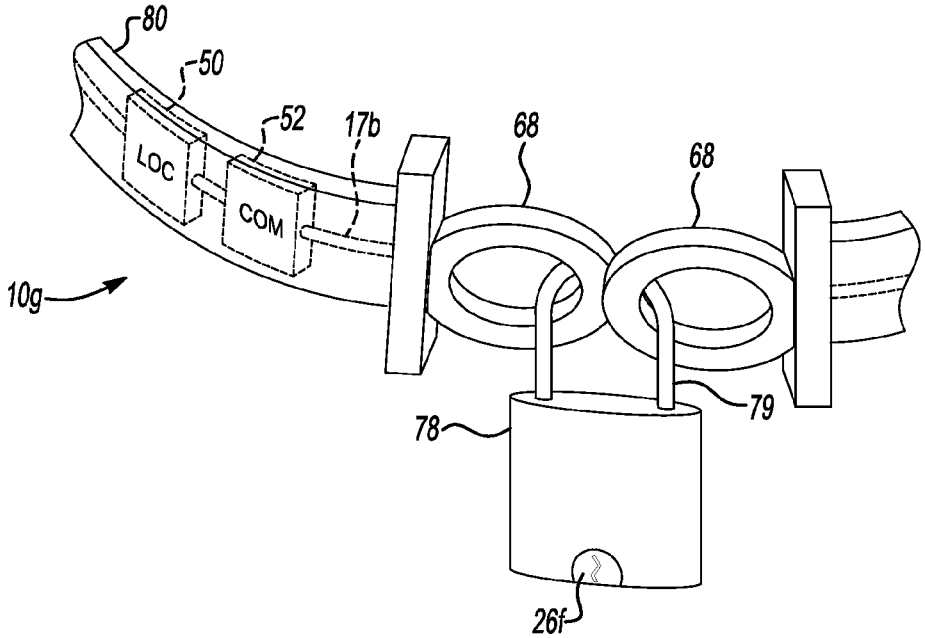
FIG. 13 illustrates a tracking device according to a seventh alternate embodiment.

FIG. 13 illustrates a seventh alternate embodiment of a tracking device 10*g*. In this example, the lock 78 is simply a lock with a retractable U-shaped portion 79 and a key-way 26*f*. The lock 78 selectively secures the two eyelets 68, which are secured to the cable 17*b* hidden within a band 80, as before. However, in this tracking device 10*g*, the locating circuitry 50 is hidden inside the band 80, as is the communication circuit 52.

Figure 14:
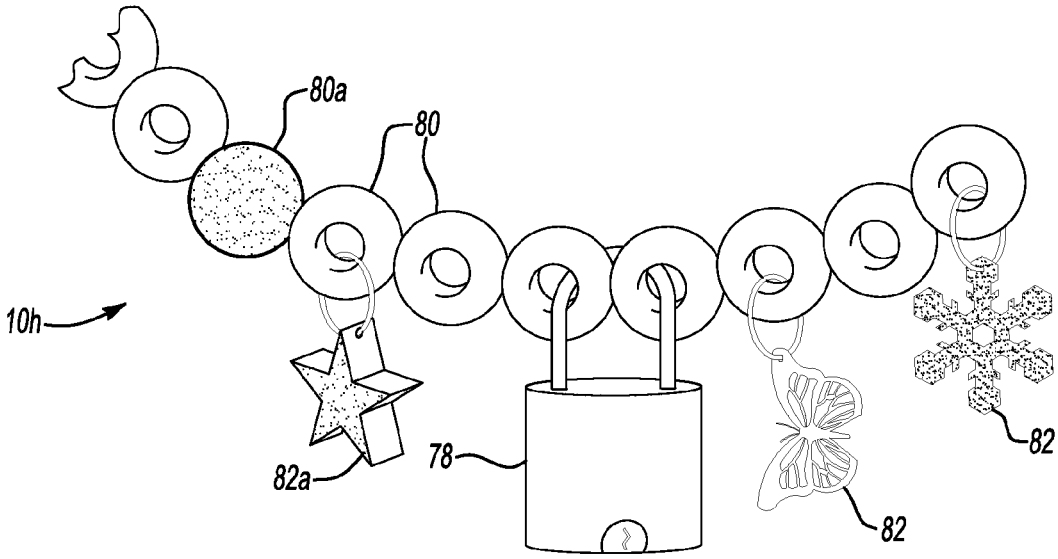
FIG. 14 illustrates a tracking device according to an eighth alternate embodiment.

FIG. 14 illustrates a tracking device 10*g* according to an eighth alternate embodiment. In this embodiment, the lock 78 connects to links 80 of a bracelet, necklace, anklet, etc. The tracking hardware (e.g. the locating circuitry 50 and communication circuit 52 of the preceding Figures) may be incorporated in one of the links 80*a* and/or may be incorporated in a charm 82*a*, where it will blend in with other charms 82 connected to the links 80.

In any of the above embodiments, the tracking device could comprise simply a communication circuit 52, which can be tracked by triangulation from cell towers, using known technology. In that manner, referring to FIG. 5, the server 64 would determine the location of the tracking device directly (i.e. without necessity of communicating the location from the tracking device).

Although an example embodiment has been disclosed, a worker of ordinary skill in this art would recognize that certain modifications would come within the scope of the claims. For that reason, the following claims should be studied to determine their true scope and content.

What is claimed is:

1. A tracking device comprising:

a band;

a locating device for use in determining a location of the tracking device, the locating device secured to the band; and a lock selectively locking the band to a user, the lock removably connecting two points of the band to form a loop, the lock connecting the two points of the band when the lock is locked and releasing the two points of the band from one another when the lock is unlocked, the lock completely removable from the band when the lock is unlocked.

2. The tracking device of claim 1 further including a communication circuit for reporting the location to a central server.

3. The tracking device of claim 1 further including a key way selectively unlocking the lock.

4. The tracking device of claim 3 wherein the key way selectively locks the lock.

5. The tracking device of claim 1 wherein the locating device includes a GPS receiver.

6. The tracking device of claim 1 wherein the locating device includes a cell communication circuit.

7. The tracking device of claim 1 further including a health monitoring circuit.

8. The tracking device of claim 7 further including a communication circuit for reporting a health condition as determined by the health monitoring circuit to a central server.

9. The tracking device of claim 8 wherein the health monitoring circuit sends a signal to the central server when a health signal is not measured by the health monitoring circuit, which indicates that the tracking device is not being worn by the user.

10. The tracking device of claim 1 wherein the locating device is inside a housing connecting two ends of the band.

11. The tracking device of claim 10 wherein the housing is a watch body with a watch display.

12. The tracking device of claim 1 wherein the lock includes a lock housing, the locating device inside the lock housing.

13. The tracking device of claim 12 wherein the lock includes a retractable U-shaped portion for connecting the two points of the band to one another.

14. A tracking device comprising:

a band;

a lock removably connecting two points of the band to form a loop, the lock connecting the two points of the band when the lock is locked and releasing the two points of the band from one another when the lock is unlocked, the lock including a lock housing; and a locating device for use in determining a location of the tracking device, the locating device inside the lock housing.

15. The tracking device of claim 14 wherein the housing has an ornamental shape.

16. The tracking device of claim 14 wherein the housing is completely removable from the band when the lock is unlocked.

17. The tracking device of claim 14 wherein the two points of the band are eyelets, the lock selectively connecting the eyelets to one another.

18. The tracking device of claim 14 wherein the lock is lockable and unlockable with a key.

* * * * *